United States Patent [19]

Wörwag

[11] Patent Number: 5,008,973

[45] Date of Patent: Apr. 23, 1991

[54] MULTI-PURPOSE SUCTION NOZZLE

[75] Inventor: Peter Wörwag, Romanshorn, Switzerland

[73] Assignee: Düpro AG, Romanshorn, Switzerland

[21] Appl. No.: 473,283

[22] Filed: Jan. 31, 1990

[30] Foreign Application Priority Data

Jan. 31, 1989 [DE] Fed. Rep. of Germany ..... 3902741
Jan. 9, 1990 [DE] Fed. Rep. of Germany ..... 4000374

[51] Int. Cl.[5] ..... A47L 5/36

[52] U.S. Cl. ..... 15/416; 15/331; 15/387; 15/417

[58] Field of Search ..... 15/416, 387, 414, 417, 15/331, 332

[56] References Cited

U.S. PATENT DOCUMENTS

| | | | |
|---|---|---|---|
| 1,470,894 | 10/1923 | Throop | 15/416 X |
| 2,348,861 | 5/1944 | Smellie | 15/416 X |
| 2,842,793 | 7/1958 | Hurd | 15/416 X |
| 2,885,716 | 5/1959 | Brown | 15/417 |
| 3,936,903 | 2/1976 | Johnson | 15/416 X |
| 4,776,059 | 10/1988 | Worwag | 15/416 X |

FOREIGN PATENT DOCUMENTS

| | | | |
|---|---|---|---|
| 109854 | 4/1925 | Switzerland | 15/416 |

*Primary Examiner*—Chris K. Moore
*Attorney, Agent, or Firm*—Robert W. Becker & Associates

[57] ABSTRACT

A multi-purpose suction nozzle, for a vacuum cleaner, for cleaning different types of surfaces, such as hard smooth surfaces, textile floor coverings, and upholstery, whereby the suction nozzle is detachably connected to a suction hose of the vacuum cleaner via a pivotably mounted connector. The suction nozzle has a housing with a first suction opening that communicates with a first flow channel, and with a second suction opening about which are provided planar slide surfaces and which communicates with a second flow channel. A brush is rotatably mounted in the housing in such a way that bristles of the brush extend through the first suction opening. A mechanism provides for selective communication of either the first flow channel or the second flow channel with the connector.

12 Claims, 14 Drawing Sheets

MULTI-PURPOSE SUCTION NOZZLE

BACKGROUND OF THE INVENTION

The present invention relates to a multi-purpose suction nozzle, for a vacuum cleaner or the like, for cleaning different types of surfaces, such as hard smooth surfaces, textile floor coverings, and upholstery, whereby the suction nozzle is detachably connected to a suction line or hose of the vacuum cleaner via a pivotably mounted connector.

To clean surfaces, especially to dry clean them, vacuum cleaners are used that are flow-connected via a suction hose with a vacuum tool, which is moved over the surface that is to be cleaned. The vacuum tool, which is preferably moved back and forth by hand over the surface that is to be cleaned, and which is connected to the suction hose that leads to the vacuum cleaner in such a way that it can be detached and again reattached, is generally also designated as a suction nozzle. These suction nozzles generally have a narrow, rectangular suction opening through which the suction air stream that is generated by the vacuum cleaner flows in at a high velocity and carries with it dust and dirt particles from the region immediately adjacent the slot-like suction opening, whereby the suction nozzle rests upon the surface that is to be cleaned and is moved back and forth thereover. Since the surfaces that are to be cleaned vary greatly, for example being hard surfaces of wood, tile, or linoleum, or being soft surfaces such as textile floor coverings or carpets, it is necessary, in order to achieve an optimum cleaning with the greatest possible protection of these surfaces, to adapt the design of the suction nozzle, especially that portion thereof that surrounds the slot-like suction opening, to the character of the surface that is to be cleaned. Thus, for example, to clean smooth, planar surfaces the region surrounding the suction opening is provided with bristles. By means of these bristles, the suction nozzle rests on the surface that is to be cleaned and during the cleaning process slides on these bristles, thereby loosening dirt particles that have adhered to the floor and sucking them in with the suction air stream. At the same time, these bristles, which have a specific length, serve to hold the suction opening of the suction nozzle at a slight distance above the surface that is to be cleaned, so that the dirt that is carried along by the inflowing suction air stream can flow in without obstruction.

To clean soft surfaces, such as textile floor coverings such as wall to wall carpeting or throw rugs, the slot-shaped suction opening is provided with smooth slide surfaces that surround it and that are moved back and forth on the textile surface that is to be cleaned when the slide surfaces rest thereupon. As a result of having the suction opening rest directly upon the surface that is to be cleaned, the suction air stream is necessarily guided through the fibers of the textile floor covering and the dirt that is deposited therein is carried along. However, since due to traffic on the textile floor covering the fibers are pressed down and at the same time the dirt that has been deposited on the surface is ground in, where soiling is significant the textile fibers should be cleaned with a brush at least every once in a while, and should again be raised. For this purpose, a rotatably driven, cylindrical brush is generally used. Various means, such as an electric motor, can be used to drive this brush.

Since during the course of cleaning, different types of surfaces are frequently encountered, with a frequent transition being made from hard smooth floors, for example tiles, linoleum, parquet, etc., to soft textile coverings such as wall to wall carpeting or throw rugs, so-called "combination nozzles" were developed. At these suction nozzles, by means of a change-over mechanism, a part embodied as a brush is moved to such an extent against the smooth hard surface that is to be cleaned that the suction opening is raised from the surface that is to be cleaned and the suction nozzle, along with this brush, is slidingly moved over the hard smooth surface that is to be cleaned. When changing to a textile surface, by actuating the change-over mechanism the brush is retracted, generally into the interior of the nozzle housing, to such an extent that the bristles thereof no longer engage the floor surface and the housing of the nozzle rests upon the textile covering that is to be cleaned, as a result of which the suction nozzle rests slidingly on the textile covering that is to be cleaned and is guided over the same.

However, if at certain spots of the textile floor covering it is necessary to have a thorough cleaning and to raise the carpet fibers or nap, the smooth suction nozzle that has been used up to now has to be replaced with a suction nozzle that has a rotatably driven, cylindrical brush. This necessitates an interruption of the cleaning process, which especially during commercial cleaning is very inconvenient, since the required suction nozzle with the rotatably driven brush is often not immediately at hand and the detachment of the suction nozzle from the suction hose is frequently difficult, since the positive plug-type connection between the suction line or hose and the connector of the suction nozzle is often very secure.

It is therefore an object of the present invention to provide a suction nozzle that has suitable suction means for various tYpes of surfaces and is easy to handle.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
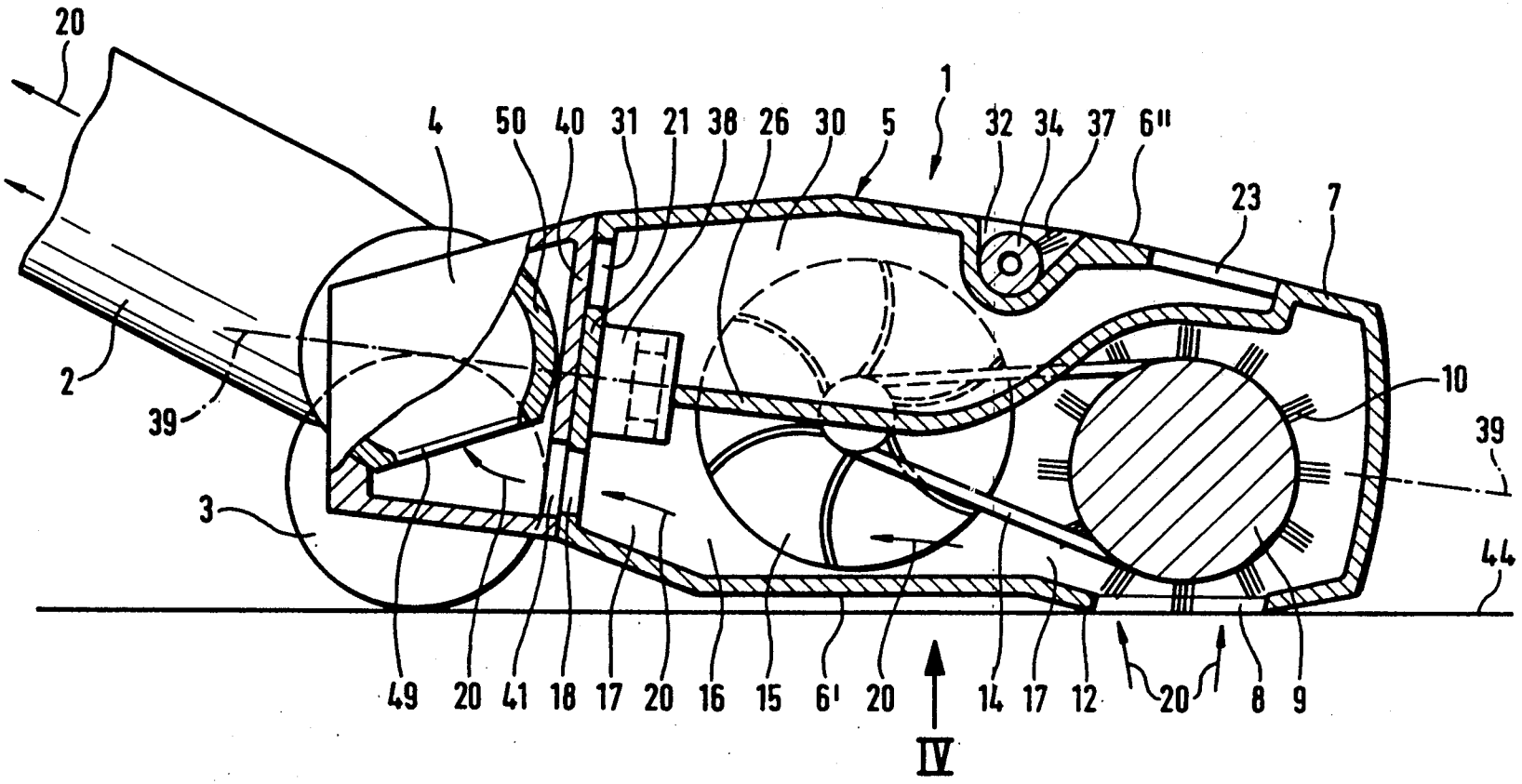
FIG. 1 is a partially broken away and cross-sectioned side view of a first exemplary embodiment of the inventive suction nozzle in a first working position.

The suction nozzle of the present invention is characterized primarily by: a housing having a first suction opening that communicates with a first flow channel, and a second suction opening about which are provided planar slide surfaces and which communicates with a second flow channel; a brush that is rotatably mounted in the housing in such a way that bristles of the brush extend through the first suction opening; and means for selectively connecting either the first flow channel or the second flow channel with the connector.

The essential advantages of the present invention are that two selectively usable suction nozzles are provided in one, with this suction nozzle taking into special consideration the various types of floor surfaces. The inventive suction nozzle can be easily changed over, whereby automatically only that suction opening with its associated flow channel is always connected to the connector, and the other flow channel is automatically closed off.

The housing is preferably embodied in such a way that in the operating position of the first suction opening, that region that surrounds this suction opening slidingly rests upon the floor surface that is to be cleaned or is guided thereover at a slight spacing therefrom. Pursuant to a further specific embodiment of the present invention, a support mechanism is preferably provided that comprises a support brush that extends essentially parallel to the length of the second suction opening, is disposed in a recess, and is mounted in such a way that the bristles thereof project out of the recess in a position of use, and in a position of nonuse retreat into the recess. In the position of use, the bristles support the housing at a specific inflow gap above the floor surface that is to be cleaned, and in addition assures that dirt particles that adhere to the floor are loosened and then sucked in.

Pursuant to one preferred specific embodiment of the present invention, the housing is essentially formed from two parts, with the connector for the suction hose being pivotably and rotatably mounted in one of the housing parts, and with the other housing part being provided with the two suction openings. Of particular advantage is an embodiment where that end of the connector that extends into the housing portion is embodied as an upholstery nozzle that can be detached from the housing. This has the advantage that the connector, which is needed in any case, is at the same time a nozzle variation, namely for cleaning upholstery, curtains, etc., that is always available as soon as the connector, via a simple detachment, is removed from the one housing portion.

The housing of the multi-purpose suction nozzle preferably has an essentially flat configuration, i.e. has a low design or low overall height, whereby two selectively usable suction openings are provided. The flow paths that adjoin the suction openings are separated from one another by partitions.

By dividing the interior of the housing into two independent flow channels, there is always assured that air is drawn in through only that suction opening that is required at that time for cleaning. For the selective use of the first or the second suction opening, the portions of the housing are rotatable relative to one another in such a way that selectively either the first or the second suction opening becomes available. Depending upon the construction of the multi-purpose suction nozzle and the arrangement of the two suction openings, the angle of rotation or pivoting for adjusting the suction nozzle from one operating position into the other is 180 or about 150°.

In order to be able to easily guide the suction nozzle over the floor surface that is to be cleaned, the housing is provided in a known manner with a roller mechanism. This roller mechanism can, for example, include rollers, whereby pairs of rollers can be mounted either only on the rear portion of the nozzle or on both ends of the nozzle.

The axis of rotation of the two portions of the housing extends essentially in the direction of the operating movement of the multi-purpose nozzle or approximately perpendicular to the floor surface, whereby in the first mentioned situation this is preferably embodied as a pivot bearing.

Pursuant to an alternative inventive embodiment, the pivot axis of a central housing portion is disposed horizontally and transverse to the direction of movement of the suction nozzle. The mechanism for the selective connection of the first or second flow channel to the connector can be embodied in a very straightforward manner by disposing in that nozzle or housing portion that accommodates the connector an inlet opening, and by providing in that nozzle or housing portion that is provided with the suction openings a discharge opening for each flow channel. In this connection, the arrangement is such that one of the discharge openings is aligned with the inlet opening, while the other discharge opening is sealed or closed off relative to the inlet opening.

In one preferred specific embodiment of the present invention, the rotatably mounted brush has a cylindrical shape and furthermore has a drive mechanism that is disposed within the front portion of the nozzle. This drive mechanism can be in the form of an electric motor or can be an air turbine that is driven by the suction air stream. Alternatively, a friction drive could also be provided that rests upon the floor surface that is to be cleaned and rotates the brush via the operating movement of the suction nozzle. The air turbine is expediently disposed in a turbine chamber in the first flow channel and is connected with the brush via a belt drive.

A particularly straightforward and easy to handle arrangement of the upholstery nozzle is provided if this nozzle has spherical lateral ends and is provided with a flattened portion to form an upholstery section opening, whereby for a positive connection, the housing portion has two spherical sockets as bearing surfaces. An easy detachment and reattachment between the connector and the rear portion of the nozzle is provided if the spherical ends of the upholstery nozzle are held between the spherical bearing surface sockets via the resilient return force of the material of the housing portion.

Further specific features of the present invention will be described in detail subsequently.

DESCRIPTION OF PREFERRED EMBODIMENTS

Referring now to the drawings in detail, FIG. 1 illustrates a multi-purpose suction nozzle 1 that has a housing 5 which includes a rear nozzle portion 4 and a front nozzle portion 7. The rear nozzle portion 4 is provided with rollers 3 and serves for receiving a connector 2 to which is connected a non-illustrated suction line or hose. The housing 5 has a flat configuration, with the front nozzle portion 7 having two flat sides 6' and 6" that essentially extend parallel to one another. On the flat side 6', which in the operating position illustrated in FIG. 1 is disposed on the underside and hence faces the surface that is to be cleaned, there is disposed a first suction opening 8, which is adjoined by a first flow channel 17. Disposed in this flow channel 17 is a rotatably mounted brush the bristles 10 of which extend through the first suction opening 8 and onto the floor covering 44. Disposed in the path of the air flow, which is indicated by the arrows 20, an air turbine 15 is disposed in a turbine chamber 16; the air turbine 15 is connected via a belt drive 14 with the rotatably mounted brush 9.

The front nozzle portion 7 is provided with a rear wall 21 that rests against a front wall 40 of the rear nozzle portion 4. Secured to the wall 40 is a pin that extends through the wall 21 and on which is seated a sleeve that is formed on the wall 21. In this way, a pivot bearing 38 is formed via which the nozzle portions 4 and 7 can be turned relative to one another, in which connection the surfaces of the walls 21 and 40 that rest against one another slide on one another. The axis of rotation of the pivot bearing 38 is indicated by the reference numeral 39. One inlet opening 41 is provided in the wall 40, while the wall 21 is provided with two outlet openings 18 and 31 that are disposed diametrically across from one another relative to the pivot bearing 38. The arrangement is such that in the operating position illustrated in FIG. 1, the outlet opening 18 and the inlet opening 41 are aligned with one another and thereby form the flow path for the air flow 20.

The outlet opening 31 is associated with a second flow channel 30 that begins at a second suction opening 23 on the surface 6", which in FIG. 1 forms the upper side of the housing 5. Provided on the flat side 6', in the vicinitY of the second suction opening 23, is a recess 32 in which is disposed a support brush 34. The support brush 34 is provided with bristles 37 and extends parallel to the second suction opening 23, as can be clearly seen from FIG. 5. The function of this support brush 34 will be described subsequently. The first flow channel 17 and the second flow channel 30 are separated from one another by a partition 26 that extends nearly from the front edge of the front nozzle portion 7 to the rear wall 21 thereof. The lower end of the connector 2 has a cylindrical configuration, with a flattened portion of the cylinder shape forming an upholstery suction opening 49, so that after the connector 2 has been loosened from the rear nozzle portion 4, it can be used as the upholstery nozzle 50. The lateral ends of the cylinder shape are spherical or dished, as will be explained in detail subsequently in conjunction with FIGS. 4 and 7.

Figure 2:
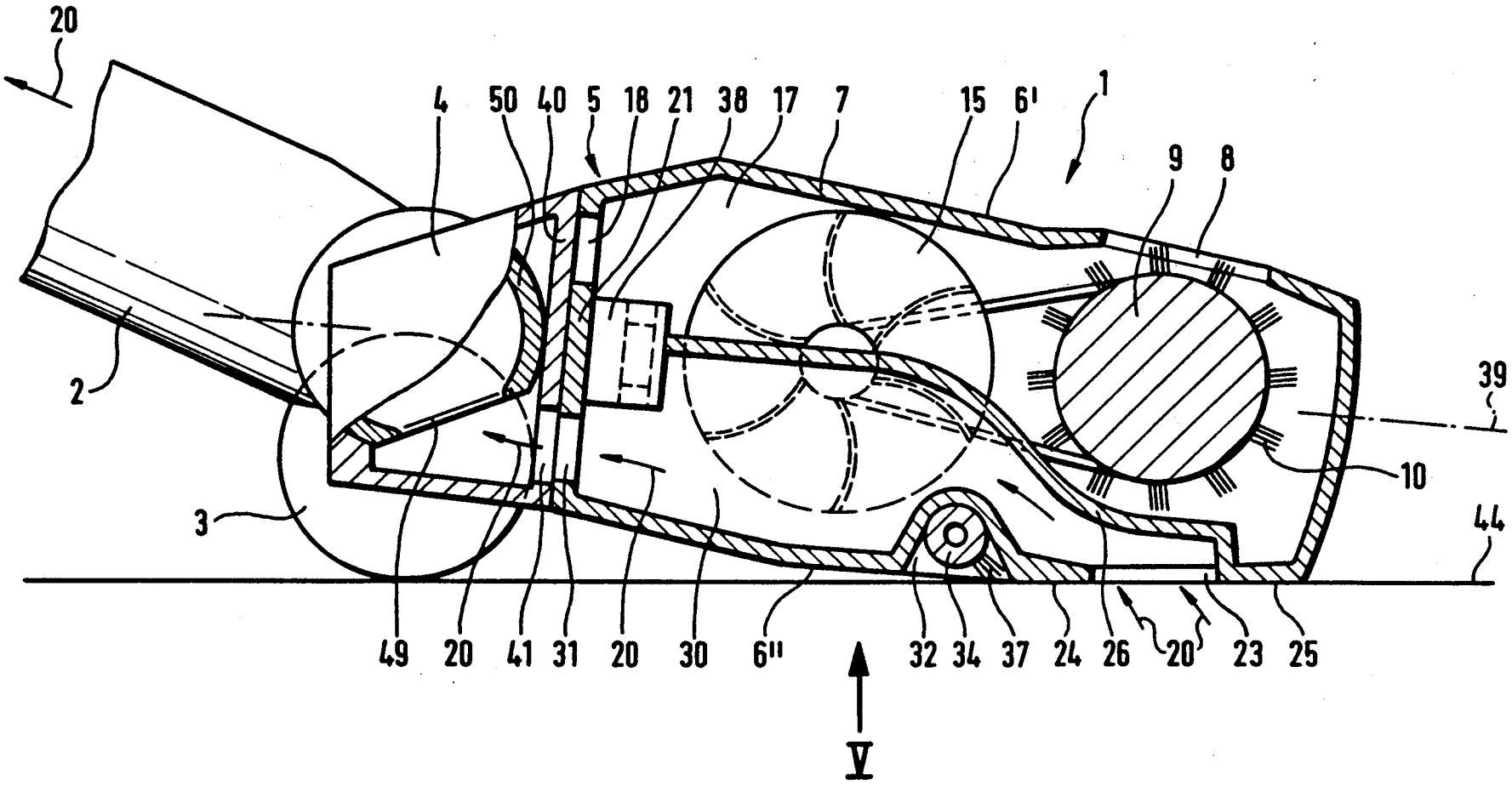
FIG. 2 shows the suction nozzle of FIG. 1 in a second working position.

FIG. 2 shows the multi-purpose suction nozzle 1 in an operating position where the flat side 6" rests upon the floor covering 44 that is to be cleaned. Aside from this changed position, all of the components discussed in conjunction with FIG. 1 coincide with the nozzle shown in FIG. 2, so that in order to facilitate understanding, the same reference numerals from FIG. 1 are used for the same parts in FIG. 2. In this operating position, the outlet opening 31 is aligned with the inlet opening 41, so that the air flow passes through the second suction opening 23 and the second flow channel 30 into the rear nozzle portion 4, from where it passes through the connector 2. At the same time, the outlet opening 18 is covered by the wall 40, so that there is no air flow in the flow channel 17 and the air turbine 15 does not move. In the position illustrated in FIG. 2, the support brush 34 is in the so-called "non-use position"; for this reason. the bristles 37 are disposed behind an edge of the recess 32. Disposed adjacent to the second suction opening 23 are slide surfaces 24 and 25 that in the non-use position of the support brush 34 rest upon the surface 44 that is to be cleaned.

Figure 3:
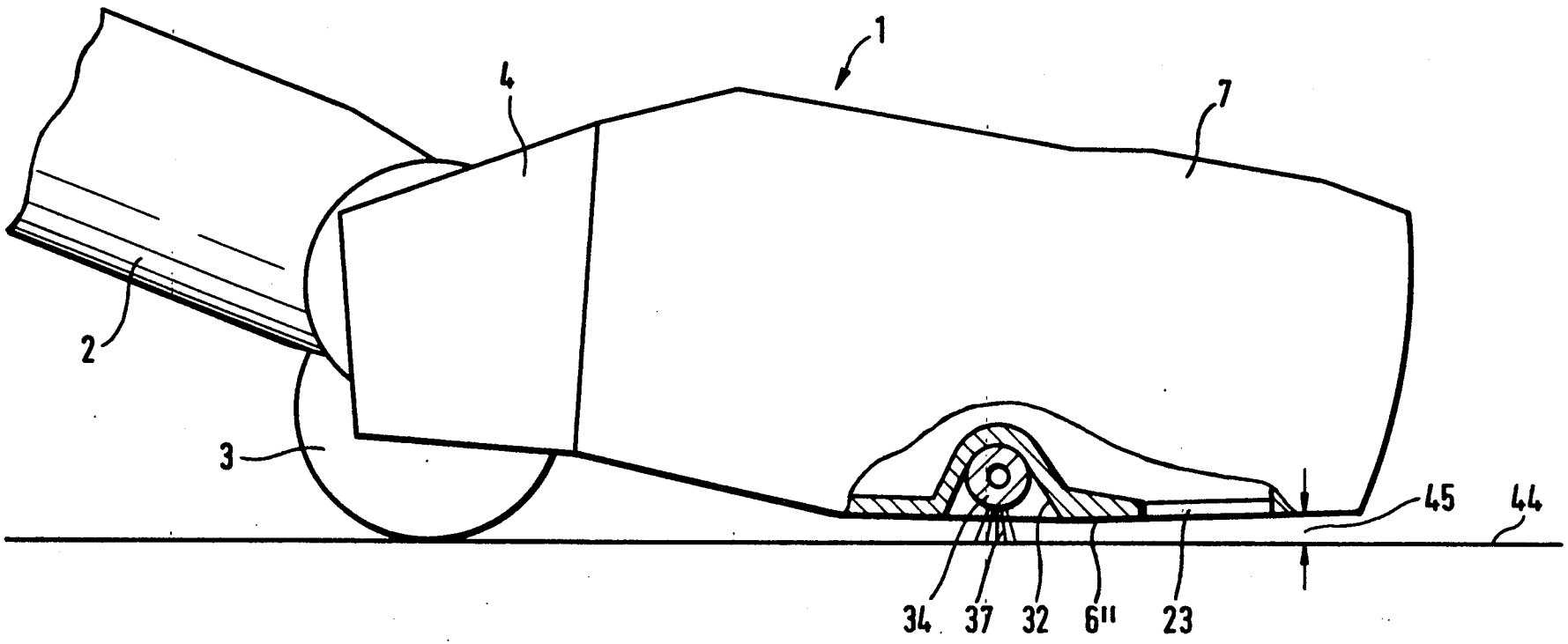
FIG. 3 is a side view of the suction nozzle of FIG. 2 with the support mechanism in the position of use.

In FIG. 3, the multi-purpose suction nozzle 1 is shown in a position in which the support brush 34 has assumed the so-called "use position" and is supported upon the surface 44 that is to be cleaned via the bristles 37. In this way, an inflow gap 45 results between the flat side 6" and the floor surface 44.

Figure 4:
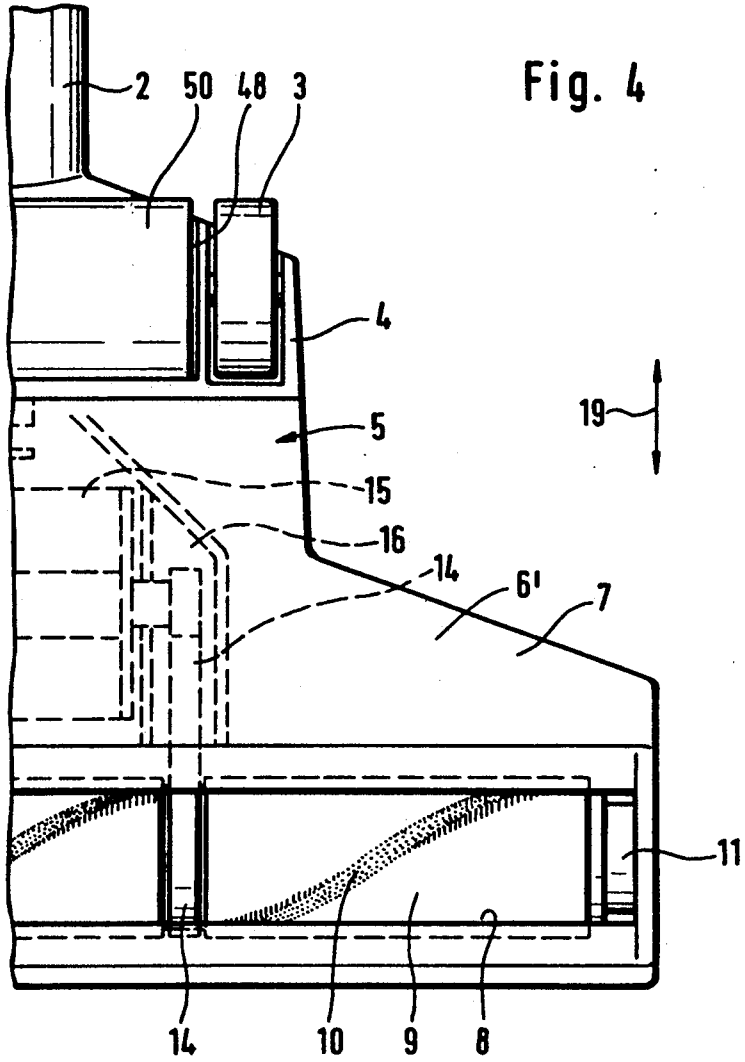
FIG. 4 is a partial view of the suction nozzle of FIG. 1 taken in the direction of the arrow IV thereof.

FIG. 4 is a partial view taken in the direction of the arrow IV in FIG. 1; in other words, FIG. 4 is a view of the flat side 6' of the housing 5. From this illustration, it can be seen that the first suction opening 8 extends transverse to the direction of operation 19 and extends over nearly the entire width of the front nozzle portion 7. Provided to the side is a bearing means 11 for the brush 9. The turbine chamber 16, in which the air turbine 15 is disposed, is arranged between the first suction nozzle 8 and the rear nozzle portion 4. The air turbine 15 is connected via a belt drive 14 with the brush 9. At that end that is disposed within the rear nozzle portion 4, the connector 2 is considerably wider, where it forms the upholstery nozzle 50 that on its lateral ends is provided with a spherical or dished surface. This shape makes it possible to have rotation between the connector 2 and the rear nozzle portion 4.

Figure 5:
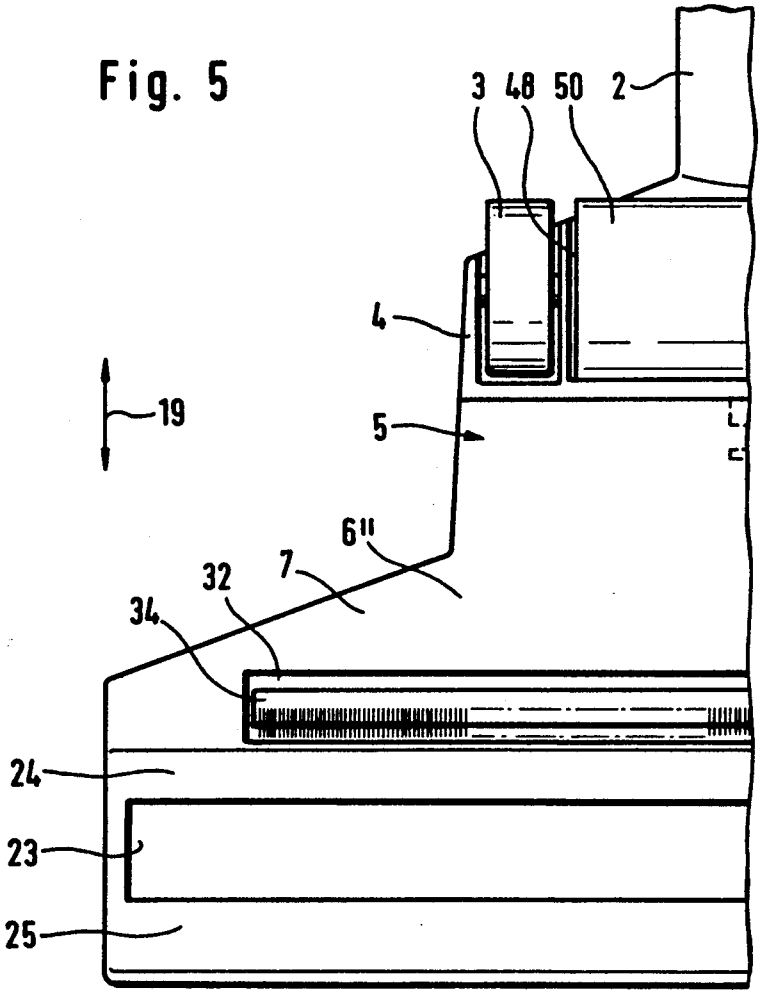
FIG. 5 is a partial view of the suction nozzle of FIG. 2 taken in the direction of the arrow V thereof.

FIG. 5 is a partial view of the housing 5 as taken in the direction of the arrow V in FIG. 2. This illustration shows that the slide surfaces 24 and 25 extend along the second suction opening 23, which is disposed transverse to the direction of operation 19 of the multi-purpose suction nozzle. Also extending parallel to the second suction opening 23 is the recess 32, which is disposed next to the slide surface 24 and in which the support brush 34 is disposed.

Figure 6:
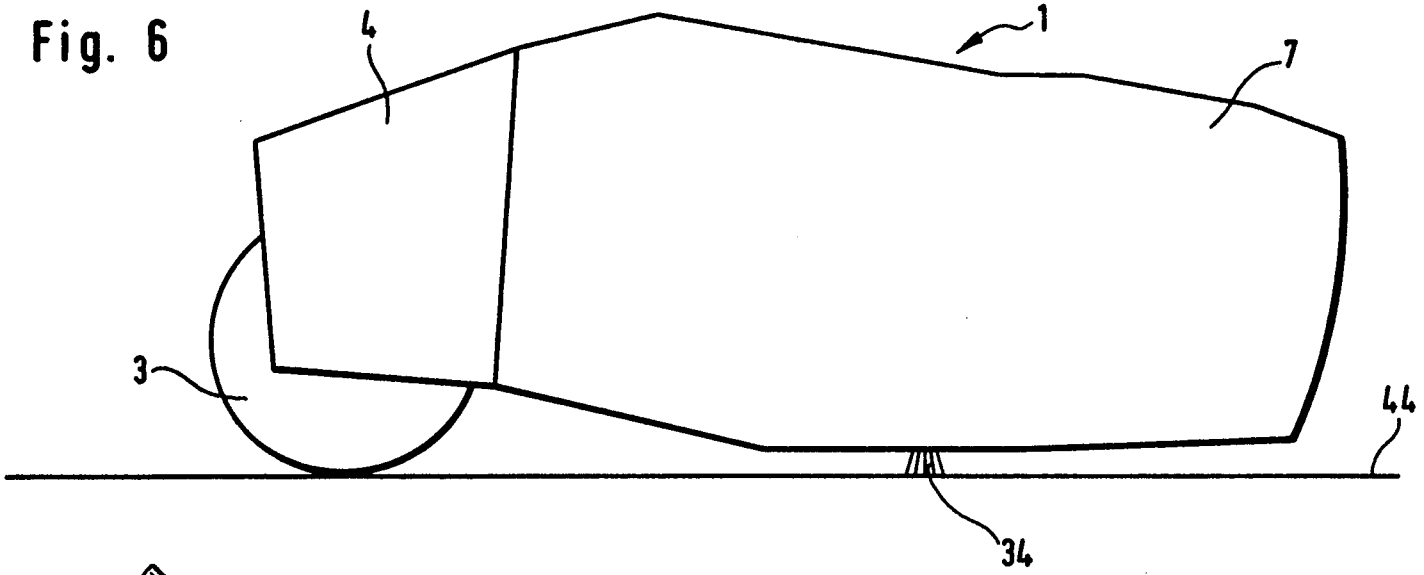
FIG. 6 is a side view of the suction nozzle of FIG. 3 with the connector removed.
Figure 7:
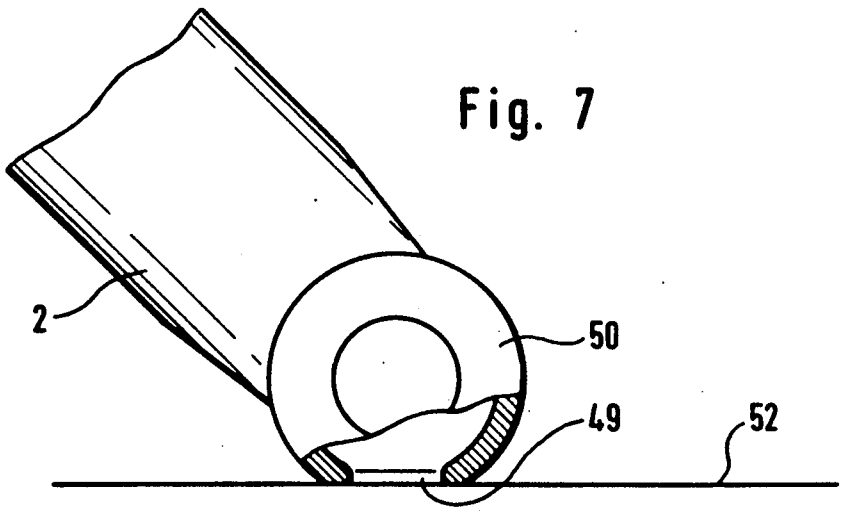
FIG. 7 shows an upholstery nozzle provided at the lower end of the connector.

FIG. 6 shows the multi-purpose suction nozzle 1 in a position in which the connector, along with the upholstery nozzle 15 formed thereon, has been removed from the rear nozzle portion 4. The connector 2, with the upholstery nozzle 50 formed thereon, is illustrated in FIG. 7, with the upholstery suction opening 49 resting upon an upholstery surface 52 that is to be cleaned. It is self understood that this upholstery nozzle can be used to clean not only planar or horizontal surfaces, but also all textile or fabric surfaces, such as wall hangings, curtains, etc.

Figure 8:
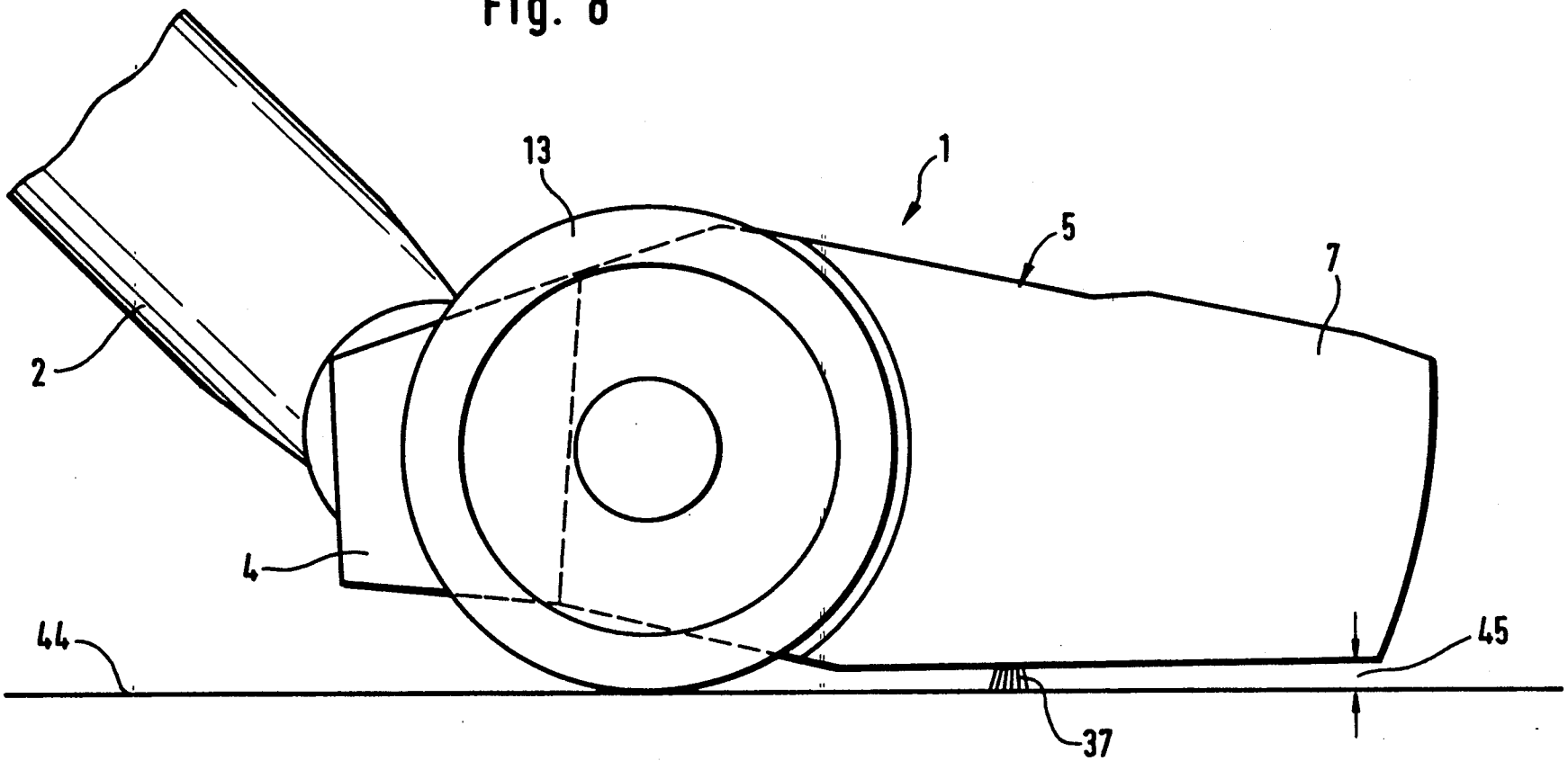
FIG. 8 shows a modified inventive multi-purpose suction nozzle with rollers.

In the embodiment illustrated in FIG. 8, the housing 5 of the multi-purpose suction nozzle 1 is not movable on the floor surface 44 via rollers disposed in the rear nozzle portion 4, but rather is movable via rollers 13 that are mounted in the rear portion of the front nozzle portion 7. Changing the arrangement of the roller mechanism does not alter the function of the multi-purpose suction nozzle 1.

The use and function of the multi-purpose suction nozzle 1 is as follows: for basic cleaning and to raise the fibers or nap of the textile floor coverings, the multi-purpose suction nozzle 1 is placed upon the floor surface 44 that is to be cleaned in such a way that the cylindrical brush 9 that is rotatably mounted in the suction opening 8, and hence the bristles 10 of the brush 9, rest upon the floor surface 44 that is to be cleaned. Similarly, the rollers 3 of the rear nozzle portion 4, which is connected to the front nozzle portion 7 via the pivot bearing 38, also rest upon the floor surface 44. By means of a non-illustrated suction hose, the connector 2 is connected with the vacuum cleaner that generates the suction air flow and collects the dirt. By means of the suction air stream that flows in through the suction opening 8, the air turbine 15 that is mounted in the turbine chamber 16 is rotated and, via the belt drive 14, drives the cylindrical brush 9. The suction air stream that flows through the air turbine 15 and the turbine chamber 16 flows through the first flow channel 17 and the outlet opening 18 and inlet opening 41 into the rear nozzle portion 4 and into the connector 2, from where it is conveyed via the non-illustrated suction hose to the vacuum cleaner. The multi-purpose suction nozzle 1 is moved over the surface that is to be cleaned via that portion of the suction hose that is embodied as a hand guide tube and is positively and flow connected with the connector 2.

To clean hard smooth surfaces, and to clean textile floor coverings that are not very dirty, the multi-purpose suction nozzle 1 is turned about the axis 39 by 180° relative to the previously described operating position, so that the second suction nozzle 23 rests upon the textile floor surface 44 that is to be cleaned via the slide surfaces 24 and 25 that are disposed about the opening 23. The suction air stream that flows in through the suction opening 23 flows through the flow channel 30, through the outlet opening 31 and the inlet opening 41, to the connector 2 in the rear nozzle portion 4, from where the air stream flows via the suction hose to the vacuum cleaner. When hard smooth surfaces are cleaned, the support brush 34 is pivoted about its longitudinal axis via a non-illustrated adjusting device to such an extent that the bristles 37 thereof rest upon the floor surface 44 that is to be cleaned, so that the slide surfaces 24 and 25 that extend about the suction opening 23 are raised from the floor surface 44 to such an extent as to reliably prevent the floor surface 44 and/or the slide surfaces 24 and 25 from becoming damaged by being scratched, while at t he same time an adequate inflow gap 45 is formed between the floor surface 44 and the flat side 6".

The inventive multi-purpose suction nozzle is additionally provided for the cleaning of upholstery surfaces, with an upholstery nozzle 50 that is easy to remove and again insert. The upholstery nozzle 50 is connected with the connector 2 in such a way that after an arresting mechanism has been loosened, the connector 2, which serves as a guide handle for the upholstery nozzle 50 and is positively and flow connected therewith, can be easily removed from the housing 5 of the multi-purpose suction nozzle 1. Thus, an upholstery surface that is encountered during the cleaning operation can be immediately cleaned without having to undergo a complicated conversion or having to have a further nozzle, whereby the guide tube of the suction hose that is connected to the connector 2 also makes it possible to clean large upholstery surfaces. After conclusion of the upholstery cleaning, the unproblematic reinsertion of the upholstery nozzle into the housing of the multi-purpose suction nozzle assures an uninterrupted continuation of the cleaning process.

FIGS. 9 to 12 show a further exemplary embodiment of the present invention. In the embodiment of the multi-purpose suction nozzle 101 illustrated in FIGS. 9 to 12, the housing 105 includes a lower portion 106 and an upper portion 111. The lower portion 106 of the housing is mounted on rollers 132. The upper portion 111 of the housing serves to receive a pivotably and rotatably mounted connector 102 to which can be connected a non-illustrated suction hose of a vacuum cleaner. The lower housing portion 106 of the multi-purpose suction nozzle 101 is embodied as a flat, rectangular parallelepiped and is provided with a first suction opening 108 and a second suction opening 123. Both of these suction openings are directed toward the floor surface 144 that is to be cleaned and extend transverse to the operating direction 119, with the spacing of the two suction openings 108 and 123 being set by the rollers 132 that rest upon the floor surface 144 that is to be cleaned in such a way that when smooth surfaces are being cleaned, an adequate inflow gap 145 remains between the lower nozzle surface portions 133, 134, 135, 136 that extend about the two suction openings 108 and 123. When textile floor coverings are being cleaned, the rollers 132 sink so deeply into the surface of the carpet that the lower nozzle surface portions 133 to 136 rest slidingly upon the nap of the carpet that is to be cleaned. The bristles 110 of the cylindrical brush 109 that is rotatably mounted in the suction opening 108 project slightly through the suction opening 108 and extend into the surface of the carpet, which is furrowed by the rotation of the brush 109. In conformity with which of the suction openings 108 or 123 is to be brought into a position of use, either the suction opening 108 via the flow channel 117 associated therewith, or the suction opening 123 via the flow channel 130 associated therewith, is alternatively flow connectable with the inlet opening 126 to the receiving chamber 118 for the connector 102.

The selective use of the first suction opening 108 with the cylindrical brush 109 that projects therethrough, or the use of the smooth second suction opening 123 that has no brush, is structured for alternative use such that only that suction opening that is disposed the furthest from the connector has a stream of suction air flowing therethrough, while that suction opening that is disposed the closest to the connector 102 is closed off relative thereto. To bring that suction opening 108 or 123 that is to be used into its position of use, the lower housing portion 106 is rotated about a vertical axis of rotation 139 relative to the upper housing portion 111. For this purpose, the upper housing portion 111 is provided with an abutment surface 128, and the lower housing portion 106 is provided with an abutment surface 120, so that the two portions of the housing rest rotatably and slidably against one another. In this manner, either the first suction opening 108 with the rotating cylindrical brush 109, or the second suction opening 123, can be brought into their position of use, whereby a rotation of the lower housing portion 106 by 180° is necessary between these two positions of use. At the same time that the suction opening 108 or 123 that is to be used is being pivoted, the opening 122 or 131 of the associated flow channel 117 or 130 is brought into alignment with the inlet opening 126 of the receiving chamber 118.

Figure 9:
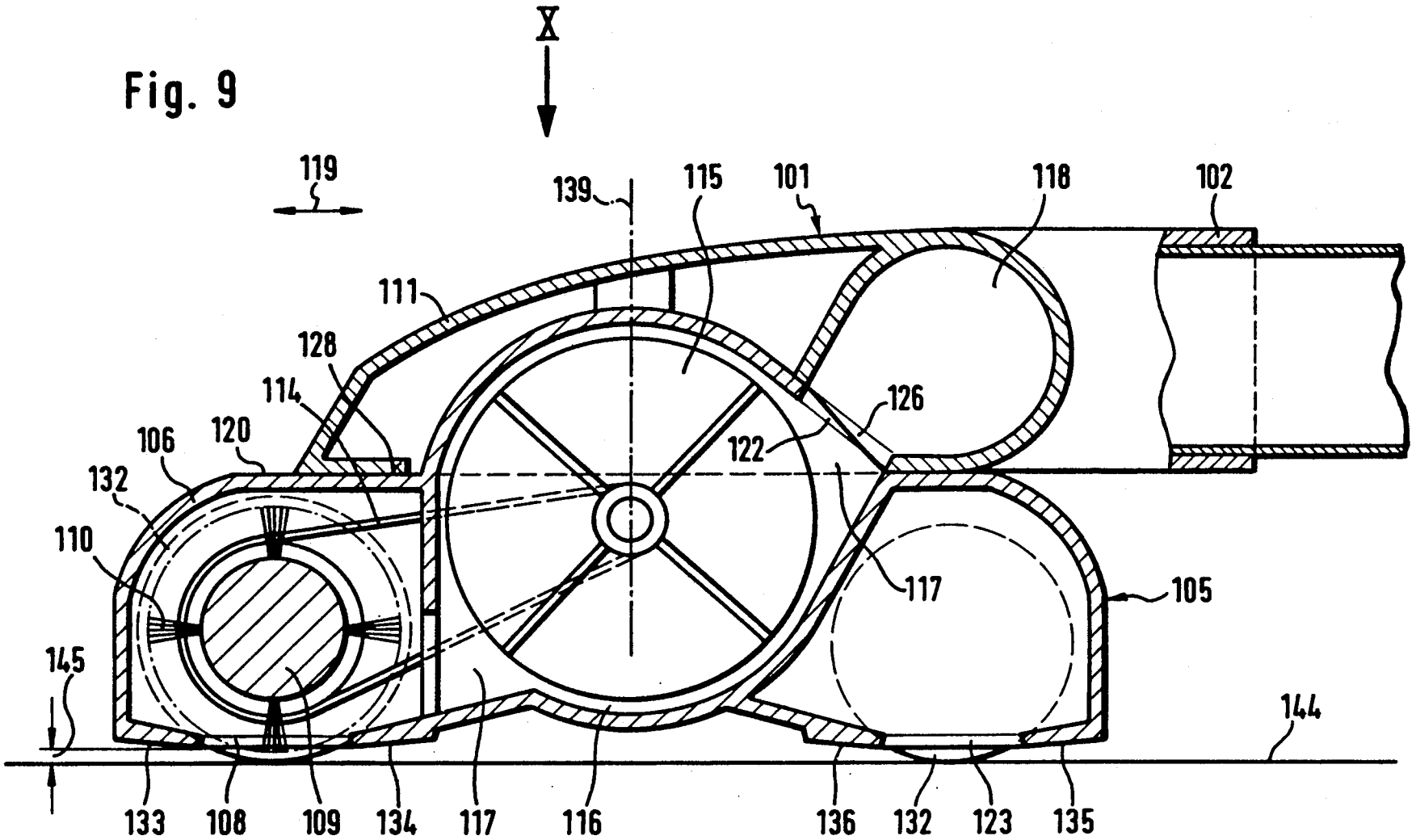
FIG. 9 is a cross-sectional view through a further exemplary embodiment of the inventive suction nozzle in a first operating position.
Figure 10:
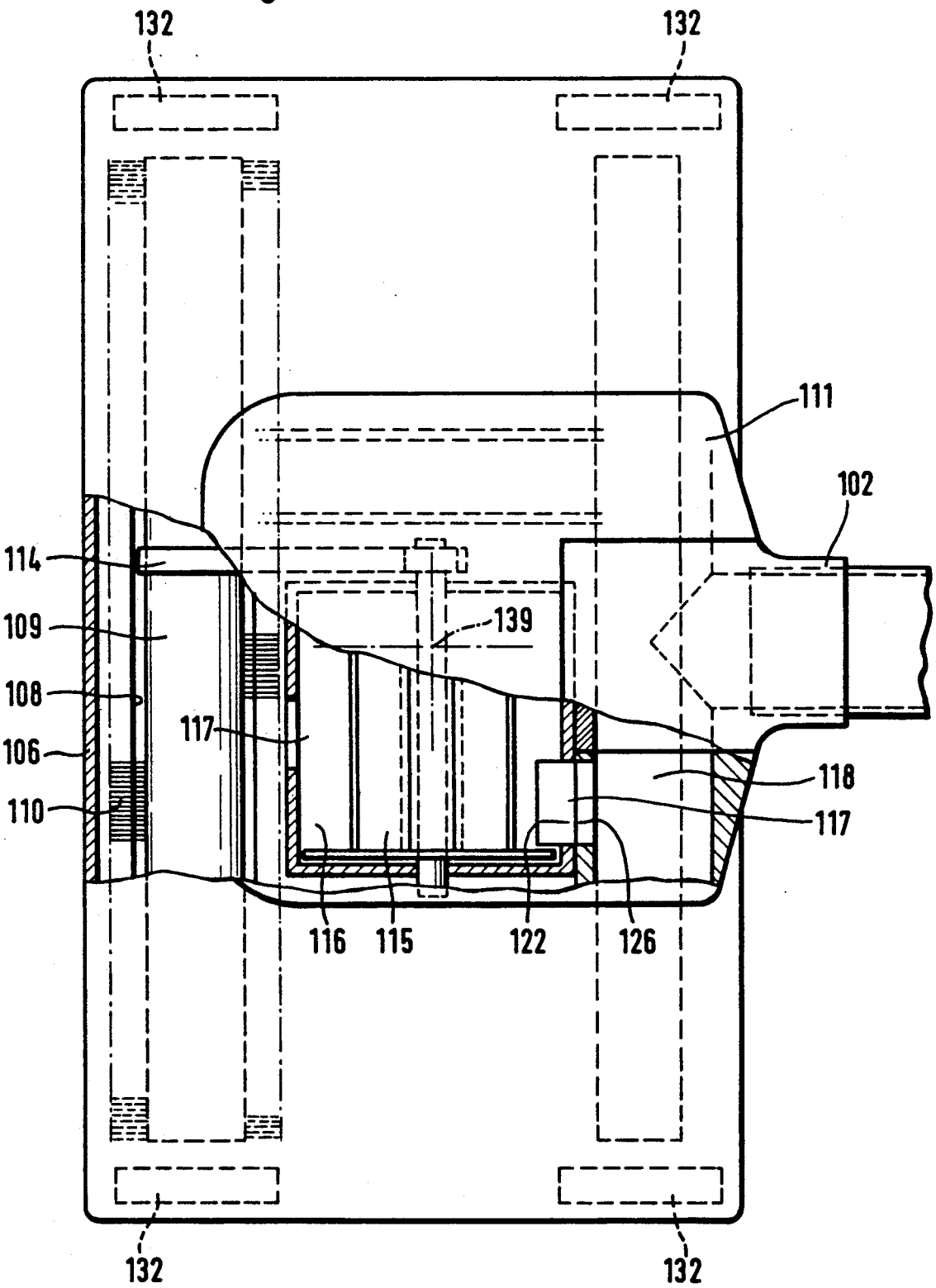
FIG. 10 is a partially broken-away view of the suction nozzle of FIG. 9 taken in the direction of the arrow X thereof.
Figure 11:
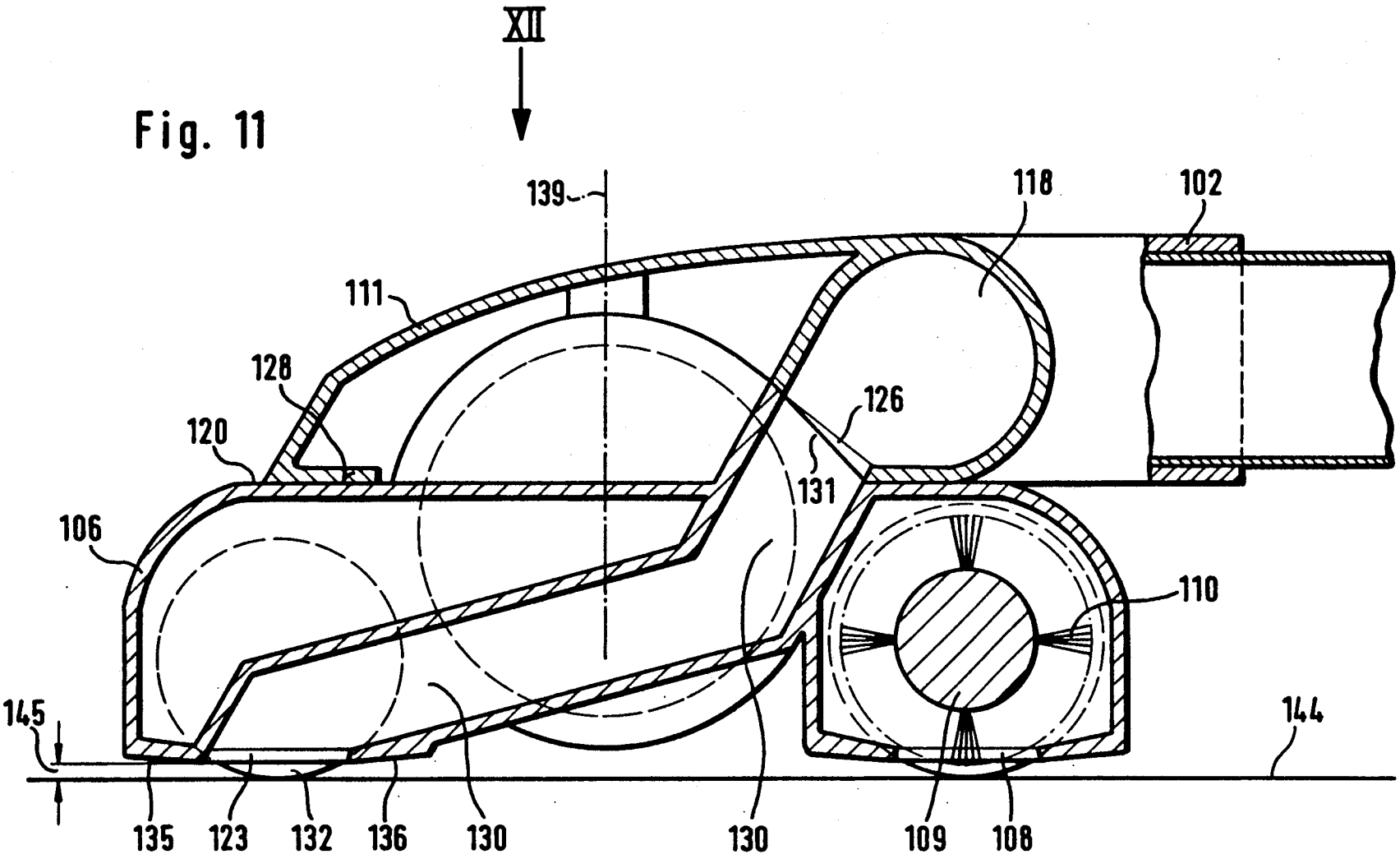
FIG. 11 shows the suction nozzle of FIG. 9 in a second operating position.
Figure 12:
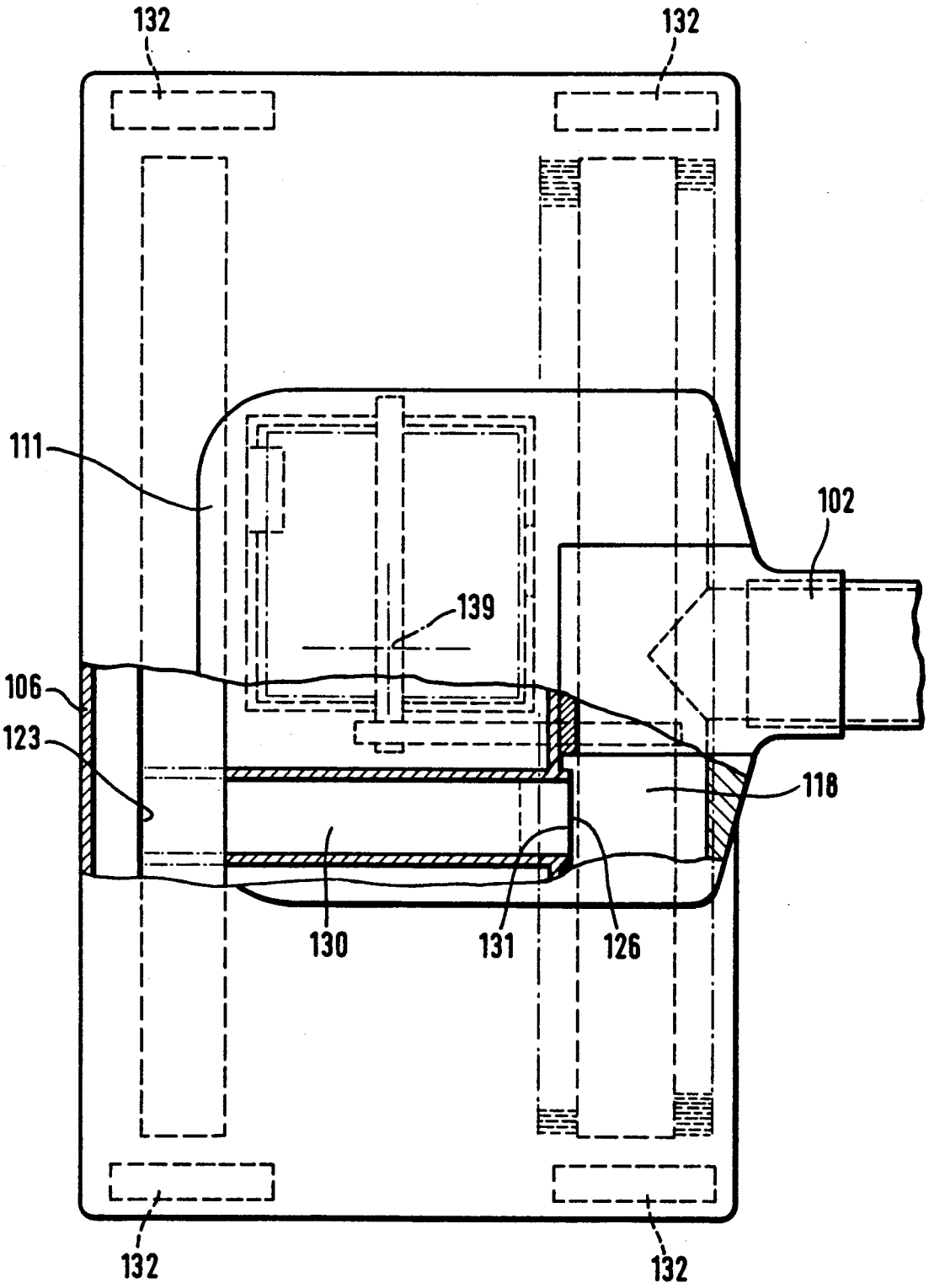
FIG. 12 is a view of the suction nozzle of FIG. 11 taken in the direction of the arrow XII thereof.

The operation of the multi-purpose suction nozzle 101 of the embodiment of FIGS. 9 to 12 is as follows:

For basic cleaning of a textile floor covering, the suction opening 108 that is provided with the rotating cylindrical brush 109 is to be used, for which purpose the suction opening 108 is brought into the position remote from the connector 102, as shown in FIG. 9. As a result, the opening 122 of the flow channel 117 is aligned with the inlet opening 126 of the receiving chamber 118 for the connector 102. The suction air that is guided by the cleaning unit via the non-illustrated suction hose flows in through the first suction opening 108, and flows through the flow path or channel 117, which is partially formed by the turbine chamber 116, with the air turbine 115 mounted therein, that is disposed in the path of this flow channel 117. By means of the suction air stream, this air turbine 115 is rotated and, via the belt drive 114, drives the cylindrical brush 109. If only the smooth second suction opening 123 that has no brush is to be used for cleaning the floor surface 144 this second suction opening 123 is pivoted into the position remote from the connector 102, as shown in FIG. 11. As a result, the opening 131 of the flow path or channel 130 is aligned with the inlet opening 126, so that the suction air stream that is generated by the cleaning unit flows in through the second suction opening 123. The result of linking up one of the openings 122 or 131 is that the respectively other opening 131 or 122 is sealed off relative to the connector 102.

A third exemplary embodiment of the present invention is illustrated in FIGS. 13 to 16. Shown is a multi-purpose suction nozzle 201, the housing 205 of which is embodied as a parallelepiped and has a first suction opening 208 and a second suction opening 223. Both of these suction openings are directed toward the floor surface 244 that is to be cleaned, extend transverse to the direction of operation 219, and form the air inlets to the associated nozzle chambers 203 or 204. When textile floor coverings are being cleaned, the surface 206 of the housing 205 rests upon the textile floor surface 244 that is to be cleaned. When hard smooth floors are being cleaned, the multi-purpose suction nozzle 201, and hence its lower housing half 206, are raised above the floor surface that is to be cleaned by two strip-like support brushes 240 and 241 to such an extent that an inflow gap 245 that is adequate for the suction air stream is formed The two strip-like support brushes 240 and 241 extend parallel to the two suction openings 208 and 223 and have approximately the same length. The two support brushes 240 and 241 are mounted in recesses 238, 239 of the lower surface 206 of the housing 205 in such a way that they can be adjusted in height, so that by actuating an adjustment device 243, the support brushes 240, 241 can be moved out of the "non-use position" shown in FIG. 13 into the "use position" shown in FIG. 15, and vice versa. In the "non-use position" of the two strip-like support brushes 240 and 241, the ends of their bristles retreat behind the plane of the lower surface 206. In the "use position" of the two support brushes 240 and 241, the ends of their bristles project beyond the plane of the lower surface 206 of the housing 205, so that the lower surface 205 is raised a few millimeters above the floor surface 244 that is to be cleaned.

Disposed between the first suction opening 208 and the second suction opening 223 is a central housing portion 212 that is pivotable about a horizontal axis and that includes two separate discharge elbows 220 and 221 that open out into a common connector 202. Disposed ahead of the discharge elbow 220 is a turbine chamber 216 in which is mounted an air turbine 215. The turbine chamber 216 is provided with an inlet opening 224 that in the position of use of the first suction opening 208 is aligned with the mouth 225 of a connecting channel 226, which is provided on the discharge side of the first nozzle chamber 203. This arrangement can be seen from FIGS. 13 and 14.

To enhance the cleaning effect of the suction air stream that is flowing into the suction nozzle, a rotatably driven, cylindrical brush 209 is mounted in the first nozzle chamber 203 in such a way that the bristles 210 thereof project slightly beyond the suction opening 208 and hence penetrate into the surface of the carpet, which is furrowed by the rotation of the brush 209. By means of a belt drive 214, the air turbine 215 that is mounted in the turbine chamber 216 drives the brush 209 that is mounted in the nozzle chamber 203 when the first suction opening 208, with the brush 209 mounted therein, is brought into its position of use, as shown in FIGS. 13 and 14.

The second discharge elbow 221 is provided with an elongated suction channel 232 that extends to an opening 237 at the second nozzle chamber 204 and is aligned therewith when the multi-purpose suction nozzle 201 is brought into the position of use of the second suction opening 223. Extending next to the longitudinal edges of the second suction opening 223 are planar slide surfaces 235 and 236 that rest upon the surface 244 that is to be cleaned when the support brush 241 is lowered into the recess 239.

The selective use of the first suction opening 208 with the cylindrical brush 209 that projects beyond this suction opening, or the second suction opening 223, is structurally embodied for alternative use in such a way that only that suction opening that is disposed remote from the connector 202 receives the suction air stream, whereas that suction opening that is disposed close to the connector 202 is closed off relative thereto. That suction opening 208 or 223 that is to be used is brought into its position of use by pivoting the connector 202, and the suction hose 218 that, in the form of a handle, is detachably connected therewith, by about 150° about the horizontal axis 217 from a nearly horizontal first end position into an oppositely disposed, also nearly horizontal second end position.

Figure 13:
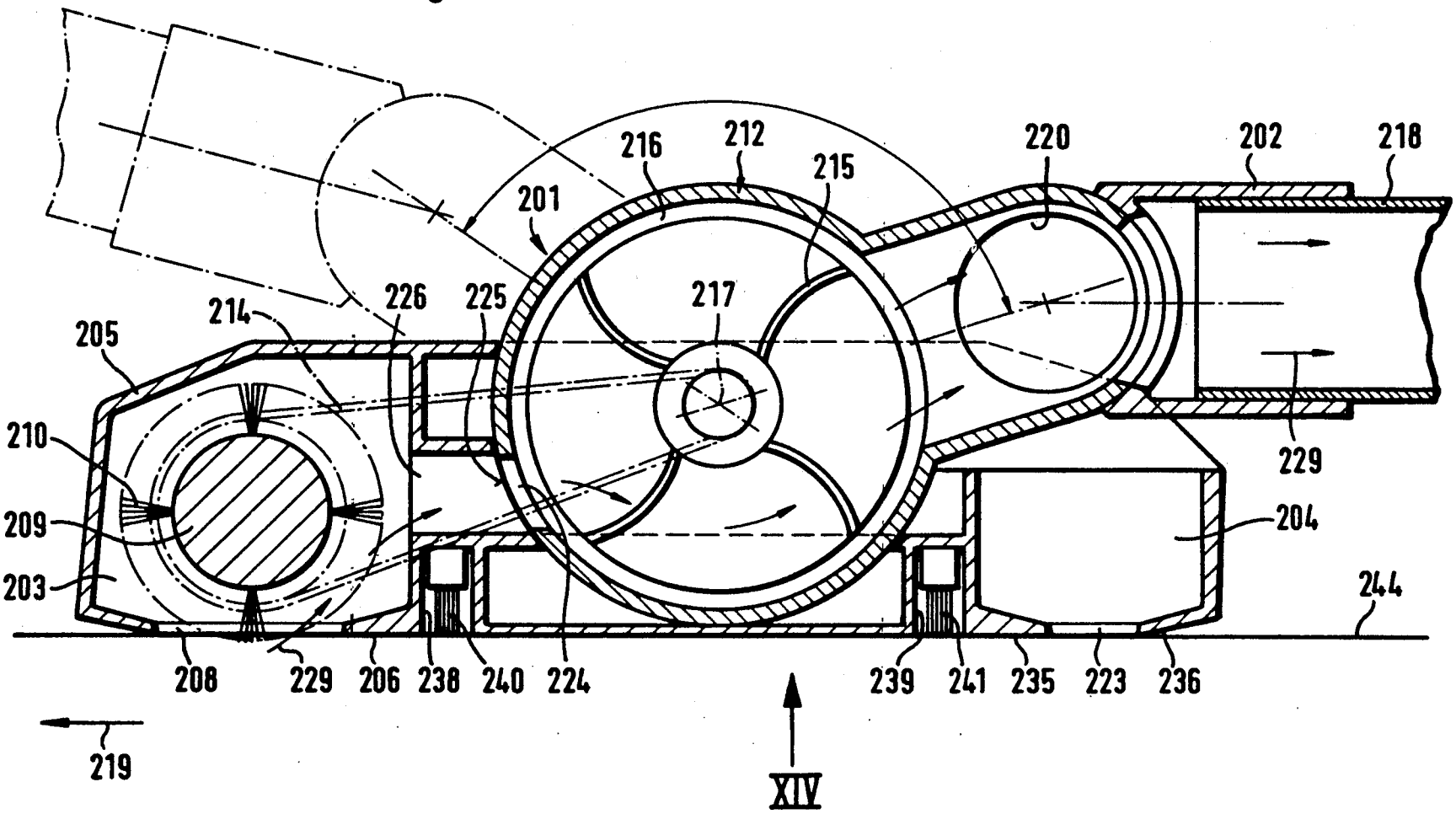
FIG. 13 is a cross-sectional view through a third exemplary embodiment of the inventive suction nozzle in a first operating position.
Figure 14:
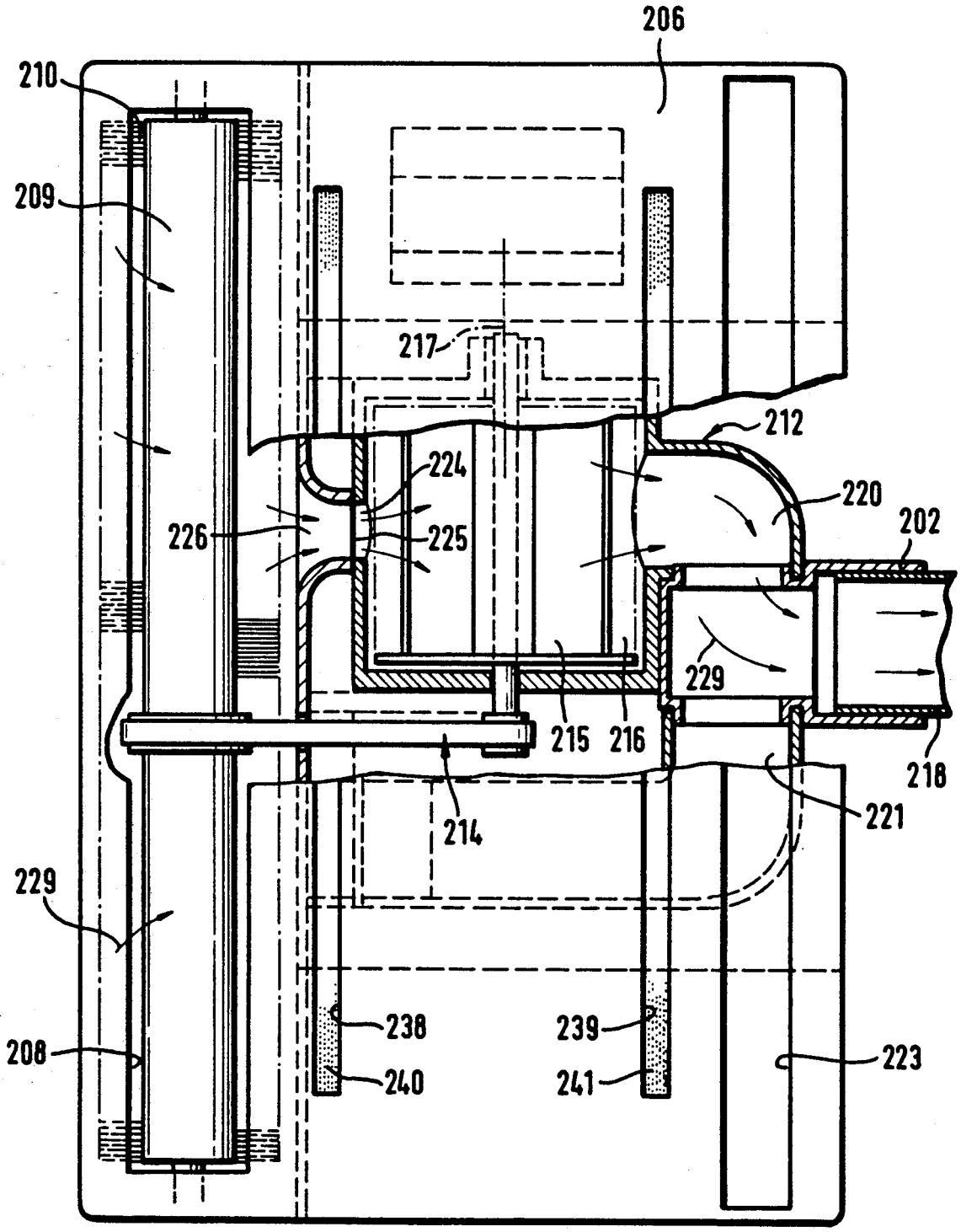
FIG. 14 is a partially broken-away view of the suction nozzle of FIG. 13 taken in the direction of the arrow XIV thereof.

In the position of the connector 202 shown in FIGS. 13 and 14, the central housing portion 212 that is pivotably mounted about the horizontal axis 217 is pivoted in such a way that the inlet opening 224 of the turbine chamber 216 is aligned, and hence is in flow connection, with the mouth 225 of the connecting channel 226. In this position, the suction air stream flows in through the first suction opening 208, flows through the first nozzle chamber 203 and the connecting channel 226, and then passes through the inlet opening 224 into the turbine chamber 216, as well as into the blades of the air turbine 215, thereby rotating the latter. After flowing past the air turbine 215, the suction air flows through the first discharge elbow 220 into the connector 202, and from there through the suction hose 218 to the vacuum cleaner, as indicated by the air stream arrows 229 in FIGS. 13 and 14. In this arrangement, the second discharge elbow 221 is blocked.

To clean the floor surface without brushes and only via suction air, the second suction opening 223 of the multi-purpose suction nozzle is used. With this type of cleaning, the central housing portion 212 is pivoted about the axis 217 by about 150° via the connector 202 and the suction hose 218 that is detachably received therein out of the previously described position of use for the first suction opening 208 and into the second position of use for the second suction opening 223, so that now this second suction opening 223 assumes a position remote from the connector 202. By pivoting the central housing portion 212 into the position of use for the second suction opening 223, the flow-connecting alignment of the mouth 225 with the inlet opening 224 of the turbine chamber 216 is interrupted, whereby a non-illustrated blocking surface covers the inlet opening 224, which has been pivoted by the pivoting movement of the turbine chamber 216.

Figure 15:
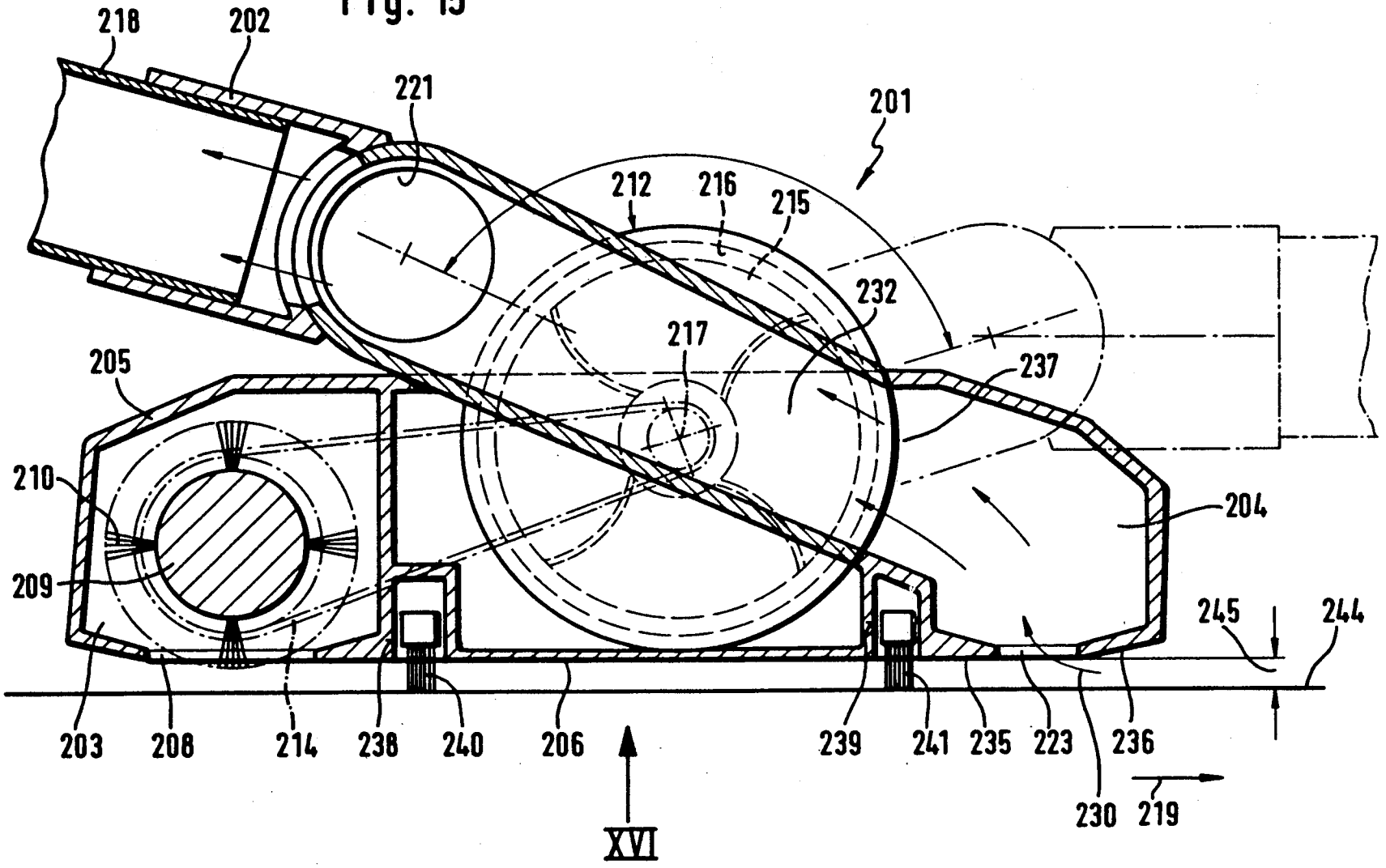
FIG. 15 is a view of the suction nozzle of FIG. 13 in a second operating position.
Figure 16:
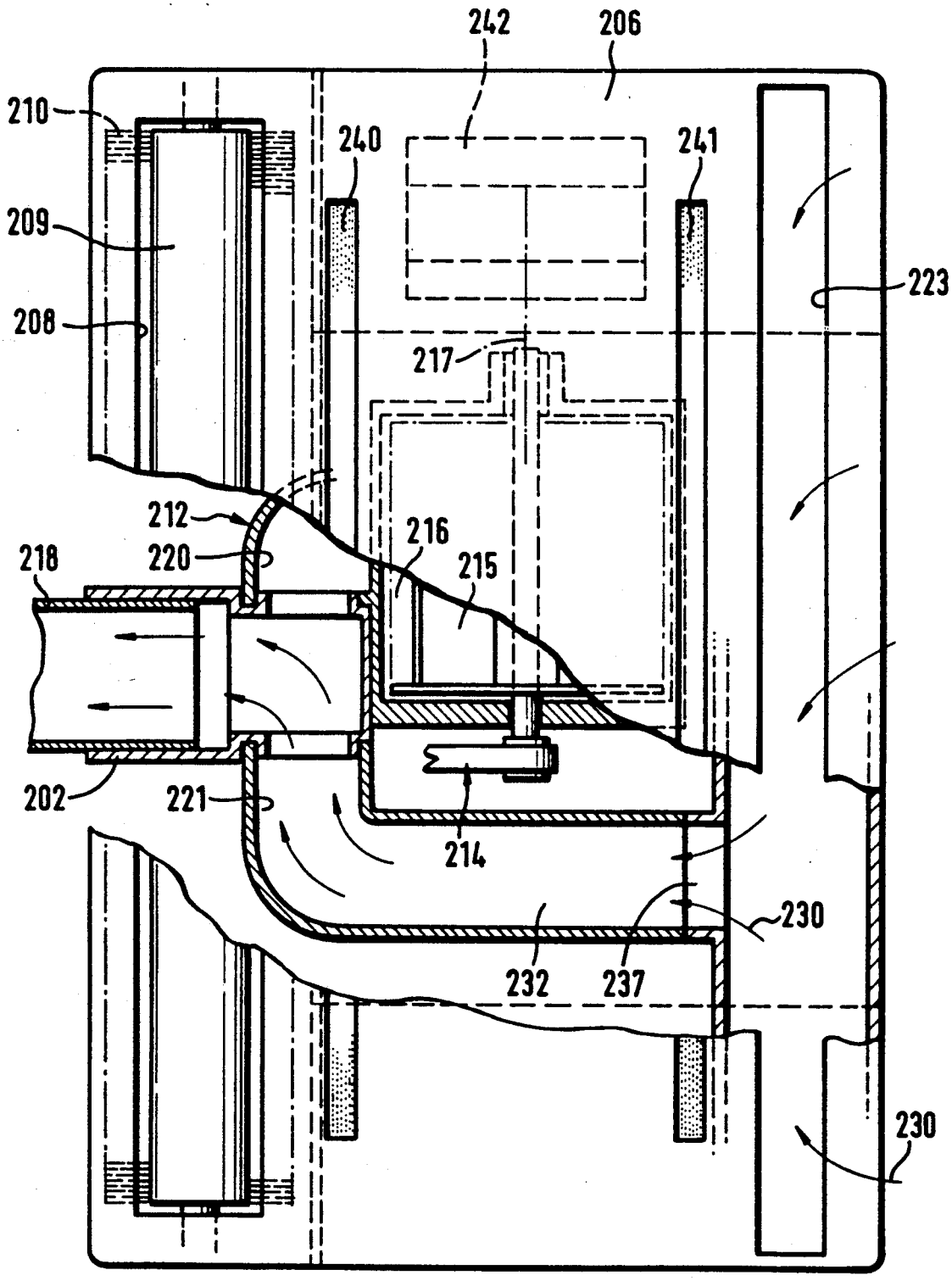
FIG. 16 is a view of the suction nozzle of FIG. 15 taken in the direction of the arrow XVI thereof.

As illustrated in FIGS. 15 and 16, in the position of use of the smooth, second suction opening 223, the suction air stream is drawn in through this second suction opening. This suction stream passes through the second nozzle chamber 204 and through the suction channel 232 into the discharge elbow 221, via which the suction air stream is introduced into the connector 202 and is conveyed via the suction hose 218 to the vacuum cleaner, as indicated by the air stream arrows 230. A blocking surface (not visible in the drawing) is associated with the opening 237 of the suction channel 232 in such a way that the opening 37 of the suction channel 232 is released only when the central housing portion 212 is in the position provided for the use of the second suction opening 223. To clean smooth, hard floor surfaces, by actuating the adjustment device 242 the two strip-like support brushes 240 and 241 are moved out of the recesses 238 and 239, so that these brushes 240, 241 project beyond the lower surface 206 of the nozzle housing 205, thereby raising this lower surface 206, along with the two suction openings 208 and 223, slightly from the floor surface that is to be cleaned, so that the inflow gap 245 that is necessary for the inflow of the suction air, and the dust and dirt particles that are carried along therewith, is formed.

The cylindrical brush 9, 109, 209 that is associated with the first suction opening 8, 108, 208 is mounted in such a way that it can be adjusted in height, so that this brush can be adjusted to the various nap heights of the carpet that is to be cleaned in such a way that the brush rests upon the surface that is to be cleaned only due to its own weight and the pressure produced by the tension of the belt drive. In the embodiments illustrated in FIGS. 9 to 16, an additional, non-illustrated raising device is advantageous for bringing the cylindrical brush 109. 209 into an upper position that is as far away as possible from the floor when the first suction opening 108, 208 is in a position of nonuse.

With all of the embodiments of the inventive multipurpose suction nozzle, an arresting mechanism, for example in the form of a ball catch or the like, can be provided for the reliable positioning of the respective operating position The easily removable upholstery nozzle 50 described in conjunction with the embodiment of FIGS. 1 to 8 is also used with the embodiment of FIGS. 9 to 12.

The present invention is, of course, in no way restricted to the specific disclosure of the specification and drawings, but also encompasses any modifications within the scope of the appended claims.

What I claimed is:

1. A multi-purpose suction nozzle, for a vacuum cleaner, for cleaning different types of surfaces, such as hard smooth surfaces, textile floor coverings, and upholstery, whereby said suction nozzle is detachably connected to a suction line of said vacuum cleaner via a pivotably mounted connector, said suction nozzle comprising:

a housing having a first suction opening that communicates with a first flow channel, and a second suction opening about which are provided planar slide surfaces and which communicates with a second flow channel, with said housing essentially comprising a rear nozzle portion that is connected to said connector, and a front nozzle portion that is provided with said first and second suction openings, and in which said housing essentially has a low design with two oppositely disposed sides, each of which is provided with one of said suction openings; a partition is disposed between said first and second flow channels, whereby for said selective use of one of said suction openings, said front nozzle portion is rotatable relative to said rear nozzle portion in such a way that one of said sides of said housing, along with the associated suction opening, comes to rest on the floor surface that is to be cleaned;

a brush that is rotatably mounted in said housing in such a way that bristles of said brush extend through said first suction opening; and means for selectively connecting either said first flow channel or said second flow channel with said connector.

2. A suction nozzle according to claim 1, in which said front and rear nozzle portions are rotatable along an axis of rotation that essentially extends in a direction of movement of said suction nozzle, and are connected via a pivot bearing.

3. A suction nozzle according to claim 2, in which said front nozzle portion has a rear wall that is rotatably and slidingly disposed against a front wall of said rear nozzle portion; and in which said means for selectively connecting said first or second flow channel with said connector comprises an inlet opening disposed in said front wall of said rear nozzle portion, and two outlet openings disposed in said rear wall of said front nozzle portion, each of which communicates with one of said flow channels, whereby depending upon which of said suction openings is being used, the corresponding outlet opening is aligned with said inlet opening and the other outlet opening is covered by said front wall.

4. A multi-purpose suction nozzle, for a vacuum cleaner, for cleaning different types of surfaces, such as hard smooth surfaces, textile floor coverings, and upholstery, whereby said suction nozzle is detachably connected to a suction line of said vacuum cleaner via a pivotably mounted connector, said suction nozzle comprising:

a housing having a first suction opening that communicates with a first flow channel, and a second suction opening about which are provided planar slide surfaces and which communicates with a second flow channel, with said housing essentially comprising a rear nozzle portion that is connected to said connector, and a front nozzle portion that is provided with said first and second suction openings, and in which said connector for said suction line is pivotably and rotatably mounted in said rear nozzle portion via an end that is embodied as an upholstery nozzle that is detachable from said rear nozzle portion, with said upholstery nozzle having an upholstery suction opening, and with said upholstery nozzle and said rear nozzle, portion having cooperating ball-and-socket type bearing surfaces for providing a positive resilient connection therebetween;

a brush that is rotatably mounted in said housing in such a way that bristles of said brush extend through said first suction opening; and means for selectively connecting either said first flow channel or said second flow channel with said connector.

5. A multi-purpose suction nozzle, for a vacuum cleaner, for cleaning different types of surfaces, such as hard smooth surfaces, textile floor coverings, and upholstery, whereby said suction nozzle is detachably connected to a suction line of said vacuum cleaner via a pivotably mounted connector, said suction nozzle comprising:

a housing having a first suction opening that communicates with a first flow channel, and a second suction opening about which are provided planar slide surfaces and which communicates with a second flow channel, and in which said housing has an upper portion, and also has a lower portion in which said two suction openings are provided facing a floor surface that is to be cleaned, with said lower housing portion being mounted in such a way as to be rotatable relative to said upper housing portion about a substantially vertical axis, and with said upper and lower housing portions being provided with respective abutment surfaces that rest slidingly against one another;

a brush that is rotatably mounted in said housing in such a way that bristles of said brush extend through said first suction opening; and means for selectively connecting either said first flow channel or said second flow channel with said connector.

6. A suction nozzle accoridng to claim 5, in which said connector for said suction line is pivotably and rotatably mounted in said upper housing portion via an end that is embodied as an upholstery nozzle that is detachable from said upper housing portion, with said upholstery nozzle having an upholstery suction opening, and with said upholstery nozzle and said upper housing portion having cooperating ball-and-socket type bearing surfaces for providing a resilient positive connection therebetween.

7. A suction nozzle according to claim 5, in which said means for selectively connecting said first or second flow channel with said connector comprises an inlet opening disposed in said upper housing portion, and two outlet openings disposed in said lower housing portion, each of which communicates with one of said flow channels, whereby depending upon which of said suction openings is being used, the corresponding outlet opening is aligned with said inlet opening and the other outlet opening is closed off relative to said inlet opening.

8. A multi-purpose suction nozzle, for a vacuum cleaner, for cleaning different types of surfaces, such as hard smooth surfaces, textile floor coverings, and upholstery, whereby said suction nozzle is detachably connected to a suction line of said vacuum cleaner via a pivotably mounted connector, said suction nozzle comprising:

a housing having a first suction opening that communicates with a first flow channel, and a second suction opening about which are provided planar slide surfaces and which communicates with a second flow channel, and in which said housing includes a central portion that is pivotable about a horizontal axis relative to the remainder of said housing, in which said first and second suction openings are provided, with said central housing portion being provided with said first and second flow channels, which are separated from one anther and open into a common discharge channel that is formed by said connector, which is movably mounted on said central housing portion, which has a pivot angle of about 150° between a position of use for said first suction opening and a position of use for said second suction opening;

a brush that is rotatably mounted in said housing in such a way that bristles of said brush extend through said first suction opening; and means for selectively connecting either said first flow channel or said second flow channel with said connector.

9. A suction nozzle according to claim 8, in which a suction air stream flows through only that suction opening that is remote from said connector, with the other suction opening being closed off relative to said connector.

10. A suction nozzle according to claim 8, in which said first flow channel comprises a first nozzle chamber that communicates with said first suction opening, and a connecting channel from said first nozzle chamber, via a mouth, to an inlet opening of a turbine chamber that communicates via a first discharge elbow with said connector, while said second flow channel comprises a second nozzle chamber that communicates with said second suction opening, and an opening from said second nozzle chamber into a suction channel that communicates via second discharge elbow with said connector.

11. A multi-purpose suction nozzle, for a vacuum cleaner, for cleaning different types of surfaces, such as hard smooth surfaces, textile floor coverings, and upholstery, whereby said suction a housing having a first suction opening that communicates with a first flow channel, and a second suction opening about which are provided planar slide surfaces and which communicates with a second flow channel, and in which said housing comprises two parts that are rotatable relative to one another, whereby the angle of rotation of one of those parts from a position of use of one of said suction openings to a position of non-use thereof is 180°;

a brush that is rotatably mounted in said housing in such a way that bristles of said brush extend through said first suction opening; and means for selectively connecting either said first flow channel or said second flow channel with said connector.

12. A suction nozzle according to claim 11, which includes arresting means to prevent unintentional turning of said housing parts relative to one another.

* * * * *